United States Patent [19]

Asano

[11] 4,031,866

[45] June 28, 1977

[54] CLOSED LOOP ELECTRONIC FUEL INJECTION CONTROL UNIT

[75] Inventor: Masaharu Asano, Fujisawa, Japan

[73] Assignee: Nissan Motor Co., Ltd., Yokohama, Japan

[22] Filed: July 23, 1975

[21] Appl. No.: 598,280

[30] Foreign Application Priority Data

July 24, 1974 Japan ..... 49-84960

[52] U.S. Cl. ..... 123/32 EB; 123/32 EC; 123/32 EE; 60/276

[51] Int. Cl.[2] ..... F02B 3/00

[58] Field of Search ..... 123/32 EA, 32 EB, 32 EC, 123/32 EE; 60/276

[56] References Cited

UNITED STATES PATENTS

| | | | |
|---|---|---|---|
| 3,874,171 | 4/1975 | Schmidt et al. | 123/32 EA |
| 3,875,907 | 4/1975 | Wessel et al. | 123/32 EA |
| 3,895,611 | 7/1975 | Endo et al. | 123/32 EA |
| 3,898,962 | 8/1975 | Honig et al. | 123/32 EA |
| 3,900,012 | 8/1975 | Wahl et al. | 123/32 EA |
| 3,916,170 | 10/1975 | Norimatsu et al. | 123/32 EA |

*Primary Examiner*—Ronald H. Lazarus
*Assistant Examiner*—Paul Devinsky
*Attorney, Agent, or Firm*—Lowe, King, Price & Markva

[57] ABSTRACT

In a closed loop electronic fuel injection control unit having a basic fuel schedule in response to engine operating conditions, the amount of oxygen in the exhaust gases is detected and compared with a desired value to provide an error signal. The error signal is shaped to form a series of binary pulses of alternating voltages of constant amplitude in correspondence with the plus and minus deviation from the reference voltage which represents the desired oxygen quantity. The binary pulses are amplified by a variable gain amplifier to provide a signal which is used to adjust the basic fuel schedule. The time duration of each binary pulse is measured by a counter to provide an output when a pulse width reaches a predetermined interval. The counter output is coupled to the amplifier to increase the amplifier gain to change the rate of fuel supply.

7 Claims, 7 Drawing Figures

CLOSED LOOP ELECTRONIC FUEL INJECTION CONTROL UNIT

The present invention relates generally to electronically controlled fuel injection, and more particularly to a control unit for a closed loop electronic fuel injection.

Electronically controlled fuel injection of internal combustion engine is an accurate means of preparing the proper air-to-fuel mixture for the individual cylinders under all operating conditions. Electronically controlled fuel injection not only improves the engine performance and maximizes fuel economy, but also can curtail objectionable emissions generated by the engine. Fuel delivery is regulated by a number of sensors located strategically around the engine. These sensors convert physically measurable quantities, such as engine speed and manifold absolute pressure into proportional electrical signals which can be processed by a command circuit which determines the amount of fuel necessary to ensure the highest torque, best fuel economy and lowest exhaust emissions. The delivery of fuel to the engine is controlled by the width of the command pulse generated by the command circuit. In a sophisticated system a special sensor is provided which senses the amount of oxygen in the exhaust gases and provides an output signal which indicates the presence and concentration of pollutants. When this oxygen sensor is placed in the exhaust stream and when its signal is fed to the electronic fuel injection control unit, the fuel schedule can be adjusted to minimize harmful emissions.

However, there is an inherent lag time in the closed loop between ignition and the sensed variable. Due to the presence of lag time, a high control gain would cause system instabilities, while at a small control gain the system would substantially lose feedback control when encountered with an abrupt change in operating conditions of the engine.

Therefore, the primary object of the present invention is to provide a reliable and accurate closed loop electronic fuel injection control unit.

Another object of the invention is to provide a closed loop control circuit which provides a control signal of a constant amplitude of one of positive or negative voltages and raises the amplitude of the control voltage only when the presence of an error signal exceeds a predetermined time interval.

A further object of the invention is to provide a nonlinear feedback control circuit which senses the abrupt change in the engine operating conditions represented by the time duration of the presence of an error signal which represents the deviation of oxygen quantity from a predetermined value and whereupon increases the control voltage to rapidly bring the actual oxygen quantity to a point in the neighborhood of the predetermined value.

Briefly described, the output signal provided by the oxygen sensor is compared with a reference voltage representative of the desired oxygen quantity which minimizes the pollutants in order to provide an error signal, the amplitude of which fluctuates between positive and negative voltages to represent the deviation of the oxygen quantity from the desired quantity. In accordance with the present invention, the analog error signal is converted into binary pulses of alternating voltage of a constant amplitude which amplitude value is suitable for providing a stabilized closed loop control. A sudden change in any engine operating conditions will produce a change in the amount of oxygen in the exhaust gases which is represented by the time duration of a binary pulse of one of opposite polarities. A counter is provided to count the time duration of the pulses and provide an output when a predetermined duration is reached in order to indicate that a sudden change in the engine operating conditions has occurred. On the other hand, the binary pulse of alternating voltages is amplified by a variable gain operational amplifier. The counter output is used to increase the amplifier gain so that the rate of fuel feed to the engine is rapidly increased or decreased depending on the polarity of the control signal.

The invention will be described in detail in the following taken in conjunction with the accompanying drawings, in which.

Figure 1:
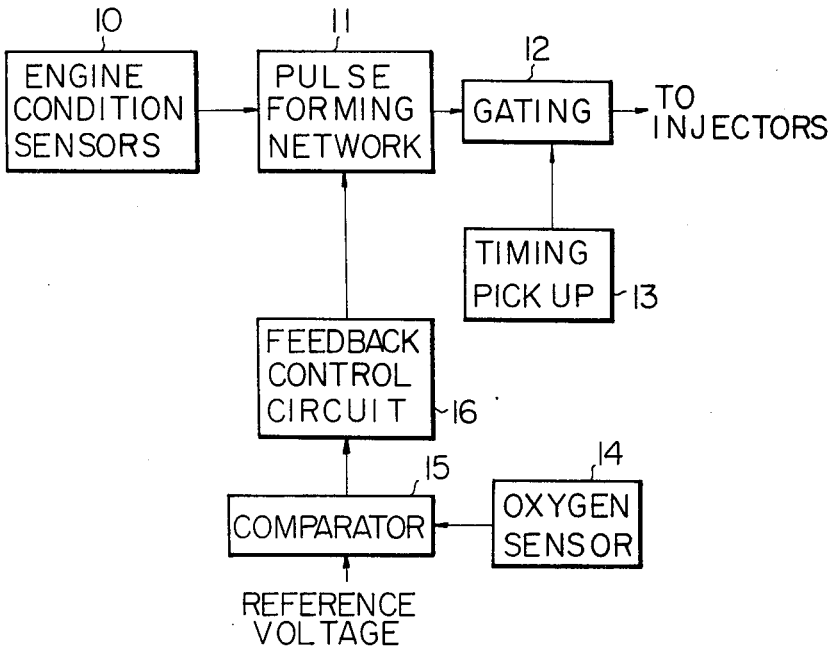
FIG. 1 is an overall functional block diagram of a closed loop electronic fuel injection control unit with a feedback control circuit of the invention.

Reference is now made to FIG. 1 in which a known closed loop electronic fuel injection control unit is shown in functional blocks. Engine condition sensors 10 which may include such as an engine temperature sensor, a manifold pressure sensor and an engine speed sensor are coupled to a pulse forming network 11. The output of the pulse forming network 11 is a train of pulses the width of which depends on a basic fuel feed schedule responsive to the engine operating conditions to regulate the quantity of fuel metered to the engine for a given cycle. The pulse output from the pulse forming network 11 is gated through a gating circuit 12 for each revolution of the engine by means of a timing pulse pickup device 13 such as a conventional distributor and applied to injectors to deliver fuel necessary for each engine cylinder. An oxygen sensor 14 which may be constructed of a hollow tube of zirconium dioxide, plated with a thin coating of platinum on both inside and outside surface. The platinum provides contact to an external electrical connnection. The sensor 14 produces an output voltage with a very sharp characteristic change in amplitude at a predetermined amount of oxygen. The amount of oxygen represented by the output voltage of the oxygen sensor 14 is compared by a comparator 15 with a desired value represented by a reference voltage to produce a positive or a negative error signal, the amplitude of which represents the amount of deviation of the detected oxygen quantity from the reference and the polarity of which represents the sensed deviation above or below the reference voltage. The comparator output 15 is fed into a feedback control circuit 16 which modifies the positive and negative error signals in a manner described below. The modified signal is coupled to the pulse forming network to modify the injector control pulse to adjust the basic fuel schedule.

Figure 2:
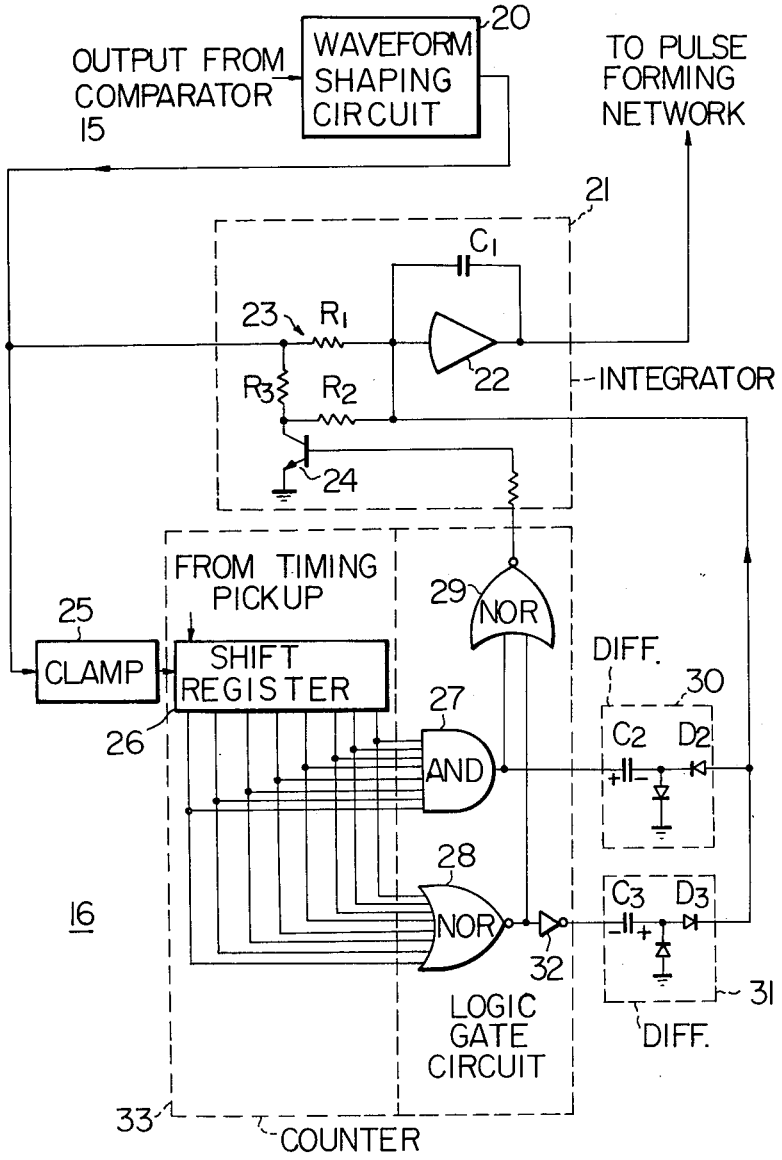
FIG. 2 is a detailed circuit diagram of the feedback control circuit of FIG. 1.

In accordance with the present invention, the feedback control circuit 16 includes, as shown in FIG. 2, a waveform shaping circuit 20 which amplifies the input voltage to sharply define the edges of the signal so that the output assumes a series of pulses of alternating polarities. The signals are shaped so that the output pulses have a constant amplitude of alternating polarities. The waveform shaper output is coupled to a variable gain operational amplifier 21 which amplifies the input voltage with a variable gain of amplification in response to a signal described later. As an example, the amplifier 21 may comprise an operational amplifier 22, an integrating capacitor $C_1$ coupled across the output and input of the amplifier 22 and a resistor network 23 comprised by resistor $R_1$ and series-connected resistors $R_2$ and $R_3$ in parallel relation with the resistor $R_1$. A switching transistor 24 has its collector coupled to the junction between resistors $R_2$ and $R_3$ and its emitter grounded.

Concurrently, the output from the circuit 20 is fed to a clamping circuit 25 which clamps the level of the input so that it delivers a series of binary digits at one of the binary levels of 1 and 0 respectively corresponding to the positive and negative pulses. The binary digit from the clamp circuit 25 is placed at the leftmost position of a shift register 26 of counter 33 and clocked thereinto in a step along manner by shift pulses supplied from the timing pickup circuit 13. The bit positions of the register 26 are represented by the binary digits and coupled to an AND gate 27 and an NOR gate 28. The AND gate 27 produces an output when all the bit positions are only at the 1 state, while the NOR gate 28 produces an output when all the bit positions are only at the 0 state. An NOR gate 29 is coupled to the output of the gates 27 and 28 so that it produces a 1 output when the output of the gate circuits 27 and 28 is simultaneously at the 0 level, and a 0 output whenever either one of the gate circuits 27 and 28 produces a 1 output. The output of the NOR gate 29 is connected to the base of the transistor 24. The transistor 24 is thus normally conductive when either of the gates 27 and 28 produces no output. Under this condition, the junction between resistors $R_2$ and $R_3$ is grounded by conduction of transistor 24 and thus the resultant resistance of the network 23 becomes equal to the resistance of resistor $R_1$. Therefore, the RC integrating time constant of the integrator 21 remains at a high value. Since the voltage output from the integrator 21 is proportional to the reciprocal of the time constant value the ingegrator output increases in voltage with time at a low rate under the normal condition.

When the width of the pulse from circuit 20 exceeds a count of eight clocks or shift pulses, all the bit positions of the shift register 26 will be occupied with 1 binary digits so that AND gate 27 produces a 1 output, thus causing transistor 24 to turn off. Resistors $R_2$ and $R_3$ are brought into parallel circuit with resistors $R_1$ and lower the resultant resistance value of the network 23. This in turn raises the rate of rise in voltage at the integrator output which instructs the pulse forming network 11 to modify its output pulse in such manner that the fuel quantity supplied for a given piston stroke is increased so that the oxygen content in the emissions returns to the reference value at a rapid rate.

In like manner, when a negative output pulse from circuit 20 exceeds a count of eight clocks, the bit positions of the shift register 26 will be filled up with 0 bit and NOR gate 28 will produce a 1 output which causes the rate of rise in voltage at the output of operational amplifier or integrator 21 to increase.

The feedback circuit 16 preferably comprises a differentiator 30 coupled to the output of AND gate 27 and a differentiator 31 coupled to the output of NOR gate 28 through an inverter 32.

Figure 3:
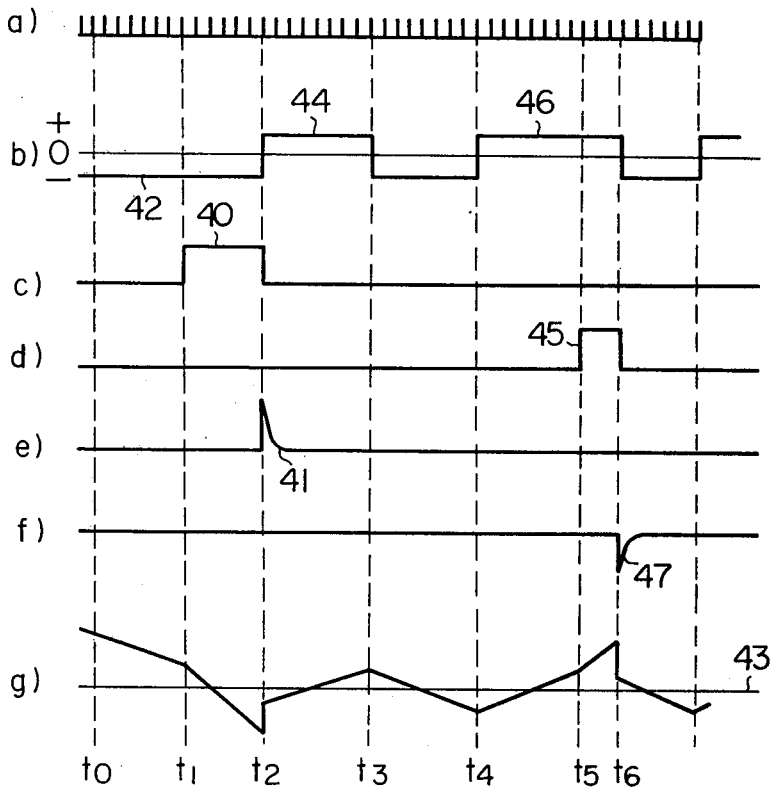
FIG. 3 is a waveform diagram useful in describing the operation of the circuit of FIG. 2.

Actual operation of the feedback circuit 16 will be described with reference to FIG. 3. The waveform shaping circuit 20 is assumed to produce a waveform shown in FIG. 3*b* and clock pulses are generated as shown in FIG. 3*a*. A first overtime signal 40 will be produced at time $t_1$ by NOR gate 28 upon counting eight clock pulses. At time $t_2$ where the error signal rises to the 1 binary level, the overtime signal 40 will cease. During times $t_1$ $t_2$ capacitor $C_3$ of differentiator 31 is charged in a sense as shown in FIG. 1 and at time $t_2$ the stored energy is discharged though a diode $D_3$ and a positive pulse 41 is produced (FIG. 3*e*). On the other hand, the error signal 42 has been accumulated in the integrating capacitor $C_1$ of operational integrator 21 and the voltage at the integrator output increases in a negative sense at a lower rate between time $t_0$ to time $t_1$. A time $t_1$, the rate of rise in negative voltage is increased. The integrator output will exceed an optimum level 43 and at time $t_2$ the positive pulse pulse 41 will compensate for the excess value and the integrator output sharply drops to a level in the neighborhood of the optimum level 43 (FIG. 3g).

During time interval $t_2$ to $t_3$, the integrator output increases in a positive sense at a rate which is equal to the rate at which the voltage varies between times $t_0$ to $t_1$. A similar process will continue until the next overtime signal 45 is produced at time $t_5$ in the presence of a 1 binary digit 46. The AND gate 27 will produce a 1 binary output which changes the rate of voltage rise in the integrator output. On the other hand, the output from AND gate 27 charges capacitor $C_2$ of differentiator 30 in a sense as shown in FIG. 2. At the trailing edge of the output from AND gate 27, the stored energy is discharged through diode $D_2$ and applied to the integrator 21 as a negative pulse 47 as shown in FIG. 3*f* which rapidly offsets the excess positive voltage and lowers it to a level in the neighborhood of the optimum level 43 at time $t_6$.

Figure 4:
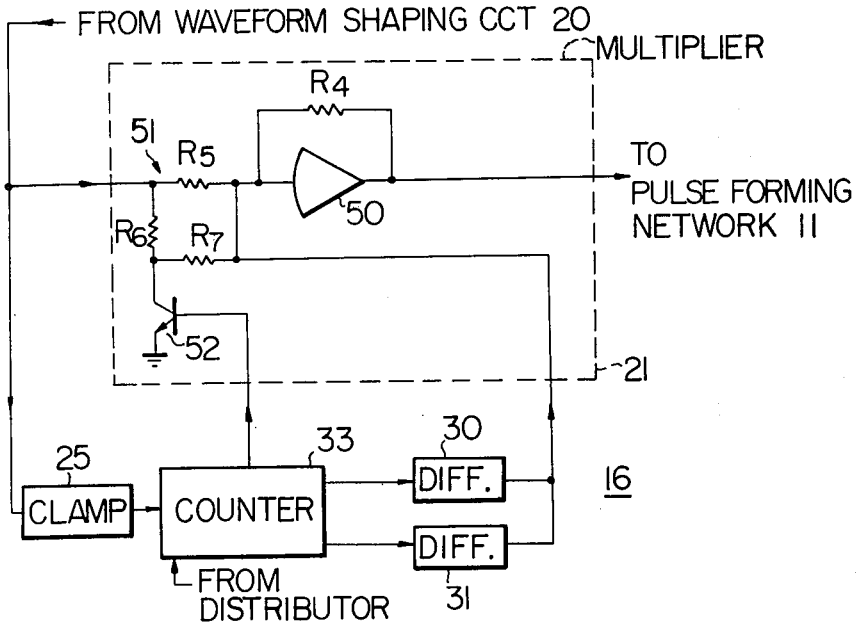
FIG. 4 is a variation of the circuit of FIG. 2.

A variation of the varible gain operational amplifier 21 is shown in FIG. 4. The amplifier 21 comprises an amplifier 50, a resistor $R_4$ coupled across the output and input to the amplifier 50, a resistor network 51 comprising $R_5$, $R_6$ and $R_7$ and a switching transistor 52 having its collector coupled to the junction between resistors $R_6$ and $R_7$ and its emitter connected to ground. The operational amplifier 21 provides a multiplication of the input voltage by the resistance ratio of resistor $R_4$ to the network 51.

Figure 5:
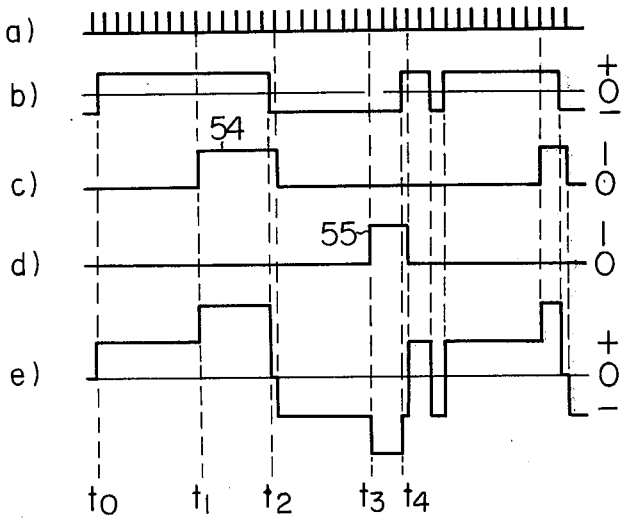
FIG. 5 is a waveform diagram useful in describing the operation of the circuit of FIG. 4.

The operation of circuit of FIG. 4 will be described with reference to FIG. 5. During time interval $t_0$ to $t_1$ to the input binary digit is at the 1 level and transistor 52 remains conductive to bring the resistors $R_6$ and $R_7$ out of circuit and makes the total resistance of the network 51 equal to resistance $R_5$. The input voltage is amplified by the ratio $R_4/R_5$. At time $t_1$, the counter 33 produces an overtime pulse 54 which is applied to the base of transistor 52 to turn it off. This lowers the total resistance of the network 51 and increases the resistance ratio, and hence the multiplication factor of the operational amplifier 21. The amplifier output thus increases from time $t_1$, to time $t_2$ (FIG. 5*e*). In the same manner, an overtime pulse 55 will be produced during time period $t_3$ to $t_4$ and the amplifier output increases to the negative maximum voltage. Differentiator outputs from circuits 30 and 31 are applied to the input to the amplifier 50. The differentiator outputs are used to compensate for the excess control voltage as previously described.

Figure 7:
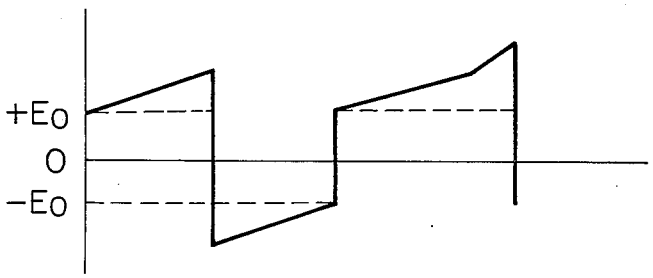
FIG. 7 is an output waveform of the circuit of FIG. 6.
Figure 6:
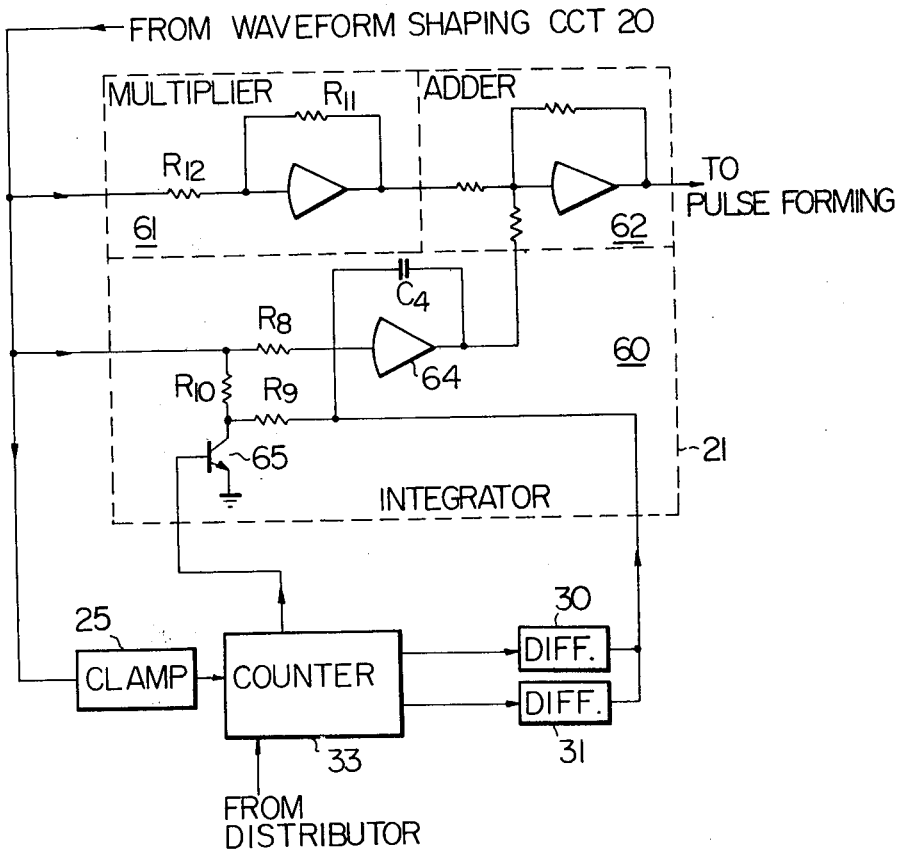
FIG. 6 is a further variation of the circuit of FIG. 2.

A further variation of the variable gain operational amplifier 21 is shown in FIG. 6 in which the amplifier 21 includes the integrator 60 a multiplier 61 and an adder 62. The integrator 60 is constructed in a configuration similar to that shown in FIG. 2 and has its input terminal coupled to the output of error signal generator 10 in parallel circuit with the multiplier 61. Both of the outputs from the integrator 60 and multiplier 61 are applied to the input to the adder 62 which sums up the input voltages. The integrator 60 comprises a switching transistor 65 which provides switching of amplification gain in response to the output from the counter in the same manner as described above. The multiplier output uniformly raises the combined voltage at the output of the adder 62 and provides a pedestal voltage $E_0$ as shown in FIG. 7.

What is claimed is:

1. An electronic fuel injection control unit for internal combustion engines including a fuel injecting device, comprising:

means including a composition sensor for sensing the concentration of the composition in the emissions from the engine and generating a correction signal at one of first and second discrete values depending upon whether the sensed concentration is above or below a predetermined value;

means for generating a train of clock pulses in step with each engine revolution;

means for counting the clock pulses to generate a first signal when the number of counted clock pulses reaches a predetermined value in the presence of the correction signal at the first discrete value and a second signal when the number of the counted clock pulses reaches the predetermined value in the presence of the correction signal at the second discrete value;

a variable gain operational amplifier responsive to the correction signal to provide a gain-controlled signal and capable of providing different amplification in response to said first or second signal from the counting means;

means for generating first and second transient signals in response to the first and second signals, respectively, from said counting means, said transient signals having opposite polarities to the polarity of the gain-controlled signal and being combined therewith; and a pulse forming network responsive to the combined signals to generate an injection pulse, the duration of which is dependent on the magnitude of the gain-controlled signal, said injection pulse being supplied to said fuel injecting device.

2. An electronic fuel injection unit as claimed in claim 1, wherein said amplifier comprises an integrating circuit having a variable time constant and switching means responsive to the first and second signals from the counting means to control said variable time constant.

3. An electronic fuel injection unit as claimed in claim 1, wherein said amplifier comprises a multiplier having a variable multiplication factor and switching means responsive to the first and second signals from the counting means to control said variable multiplication factor.

4. An electronic fuel injection unit as claimed in claim 1, wherein said amplifier comprises an integrating circuit having a variable time constant, a multiplier coupled in parallel therewith, switching means responsive to the first and second signals from the counting means to control said variable time constant, and an adder connected to the output of the integrating circuit and the multiplier.

5. An electronic fuel injection unit as claimed in claim 1, wherein said counter means comprises a shift register having a data input terminal and a shifting input terminal, the data input terminal being connected to respond to the correction signal and the shifting input terminal being connected to the clock pulse generating means to shift the input data along a row of bit positions, and a logic gate connected to the bit positions of the shift register to decode the input data in said positions to generate a third signal when said bit positions are occupied by a predetermined number of data inputs at a first binary state and a fourth signal when said bit positions are occupied by the predetermined number of data inputs at a second binary state.

6. An electronic fuel injection unit as claimed in claim 5, wherein said first and second transient signals are generated respectively by a first differentiator connected to the logic gate in response to said third signal and a second differentiator connected to the logic gate in response to said fourth signal.

7. An electronic fuel injection unit as claimed in claim 6, wherein said logic gate comprises an AND gate having its input terminals connected to the row of bit positions of the shift register and its output terminal connected to the first differentiator, a first NOR gate having its input terminals connected to the row of bit positions of the shift register and its output terminal connected to the second differentiator, and wherein said first and second signals of the counter means are generated from the output terminal of a second NOR gate having its input terminals connected to the output terminal of the AND gate and the first NOR gate.

* * * * *